US006729897B2

(12) United States Patent
Lai

(10) Patent No.: US 6,729,897 B2
(45) Date of Patent: May 4, 2004

(54) ELECTRICAL CONNECTOR HAVING THEFTPROOF MEMBER

(75) Inventor: Chin-Te Lai, Tu-Chen (TW)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/289,582

(22) Filed: Nov. 6, 2002

(65) Prior Publication Data

US 2003/0228777 A1 Dec. 11, 2003

(51) Int. Cl.[7] ..... H01R 4/50
(52) U.S. Cl. ..... 439/347; 439/352; 439/133
(58) Field of Search ..... 439/347, 345, 439/346, 350, 310, 157, 152, 352, 133

(56) References Cited

U.S. PATENT DOCUMENTS 4,227,762 A * 10/1980 Scheiner ..... 439/347
4,309,067 A * 1/1982 Riley, Jr. ..... 439/347
5,865,640 A * 2/1999 Tadokoro ..... 439/347
6,233,141 B1 * 5/2001 Lee et al. ..... 361/683
6,375,486 B1 * 4/2002 Yu ..... 439/347

* cited by examiner

*Primary Examiner*—Hien Vu
(74) *Attorney, Agent, or Firm*—Wei Te Chung

(57) ABSTRACT

An electrical connector (1) is provided for electrically mating with a mating connector (9) defining a receiving recess (95). The electrical connector includes a casing (2) and a theftproof member (8) movably disposed on the casing. The theftproof member has a latch portion (821). The theftproof member is movable between an unlocked position where the latch portion is disengaged from the receiving recess of the mating connector and a locked position where the latch portion latches into the receiving recess of the mating connector.

5 Claims, 8 Drawing Sheets

ELECTRICAL CONNECTOR HAVING THEFTPROOF MEMBER

CROSS-REFERENCE TO RELATED APPLICATION

This application is a co-pending application of U.S. patent application Ser. No. 10/106,272, entitled "PLUG CONNECTOR WITH PIVOTALLY MOUNTED LOCK RELEASE BUTTONS", filed on Mar. 25, 2002, and assigned to the same assignee as the present invention.

BACKGROUND OF THE INVENTION

1. Field of the Invention

The present invention relates to an electrical connector, and more particularly, to an electrical connector having a theftproof member.

2. Description of Prior Art

The theft of electrical apparatus such as electrical connectors, from stores selling the same, is a serious problem costing such stores a large sum of money.

Various attempts have been made in the art to prevent thefts. One such attempt is to provide electrical apparatus with electronic alarms, which are triggered by unauthorized removal. However, such electronic alarms are quite expensive and do not provide a satisfactory solution to the problem.

Another technique for preventing theft is to keep the apparatus in locked cabinets such as glass cases, or in locked racks, from which they cannot be removed by the customer. However, many customers desire to handle the apparatus and check its weight, balance, grip, and convenience of manipulation, before buying. So isolating the apparatus from the customers impedes the sale of the apparatus.

Hence, an electrical apparatus having an improved theftproof member is desired to overcome the above-mentioned shortcomings.

BRIEF SUMMARY OF THE INVENTION

The main object of the present invention is to provide an electrical connector having a simple and cheap theftproof member.

Another object of the present invention is to provide an electrical connector which is convenient for customers to touch while maintaining its theftproof function.

An electrical connector in accordance with the present invention is an adaptor. The adaptor comprises a casing, a power jack received in the casing and a theftproof member movably mounted on the casing. The power jack is provided for electrically mating with a power plug defining a receiving recess. The casing comprises an upper case and a lower case forming a pair of opposite guide portions. Each guide portion defines a standby groove and a locking groove. The theftproof member comprises a base portion, a front portion and a rear portion having a latch portion. An upper guide channel and a lower guide channel are defined in the base portion for movably engaging with corresponding guide portions. The front portion forms a pair of engaging ribs respectively projecting into the upper and the lower guide channels. When the theftproof member is in an unlocked position, the engaging ribs engage with corresponding standby grooves. When the power plug mates with the power jack and the theftproof member is biased into a locked position, the engaging ribs mate with corresponding locking grooves and the latch portion latches into the receiving recess of the power plug to lock the adaptor on the power plug.

The adaptor of the present invention may be locked on the power plug by manually moving the theftproof member without a special tool. However, without the removal tool, the locked adaptor cannot be removed from the plug because the theftproof member is too small to be manually biased to an unlocked position. The theftproof member prevents unauthorized removal of the adaptor from the power plug in public locations, such as market places and the like. Therefore, the theftproof member functions as a security lock.

Other objects, advantages and novel features of the invention will become more apparent from the following detailed description when taken in conjunction with the accompanying drawings.

DETAILED DESCRIPTION OF THE INVENTION

Figure 1:
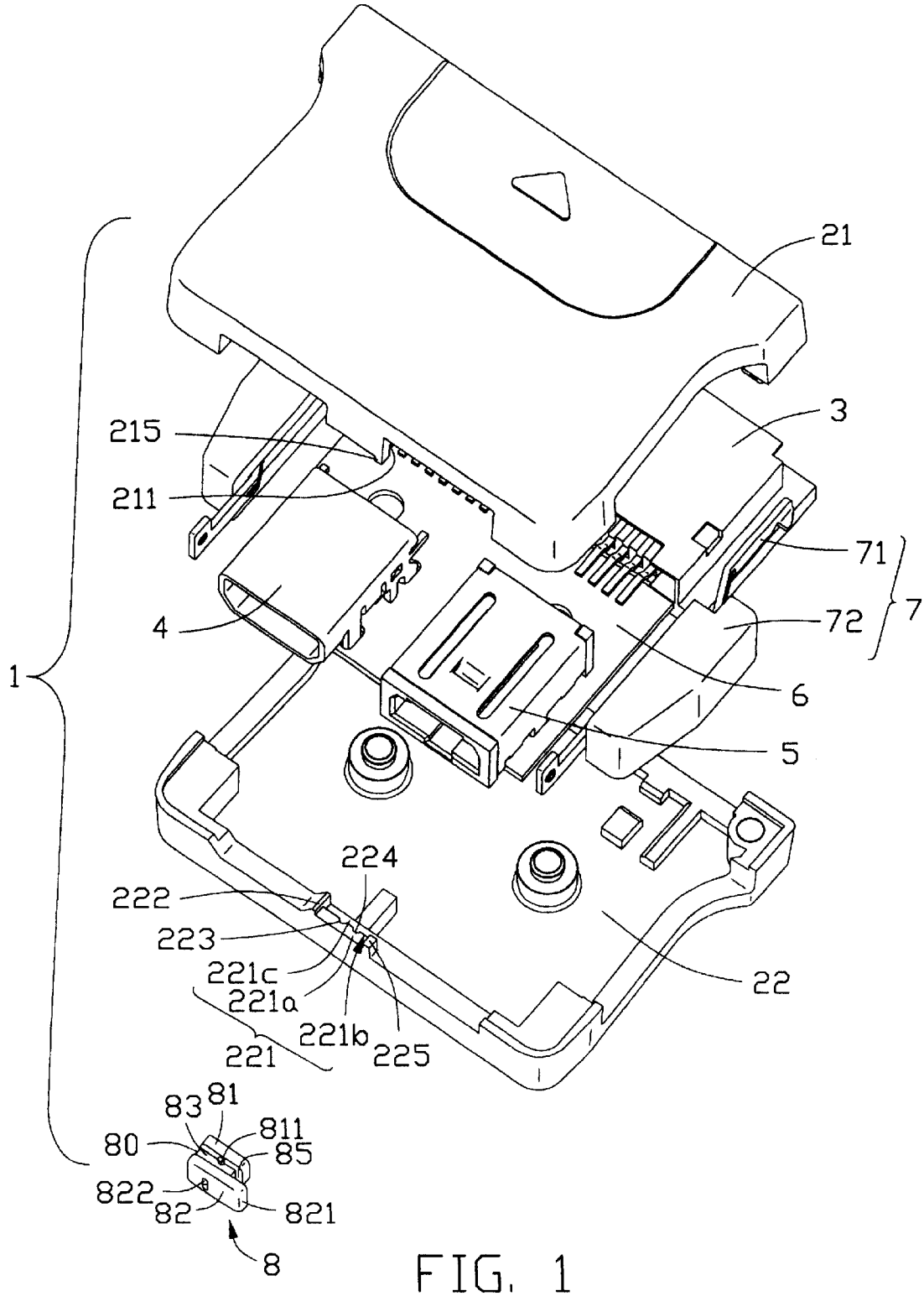
FIG. 1 is an exploded view of an electrical connector according to the present invention.
Figure 2:
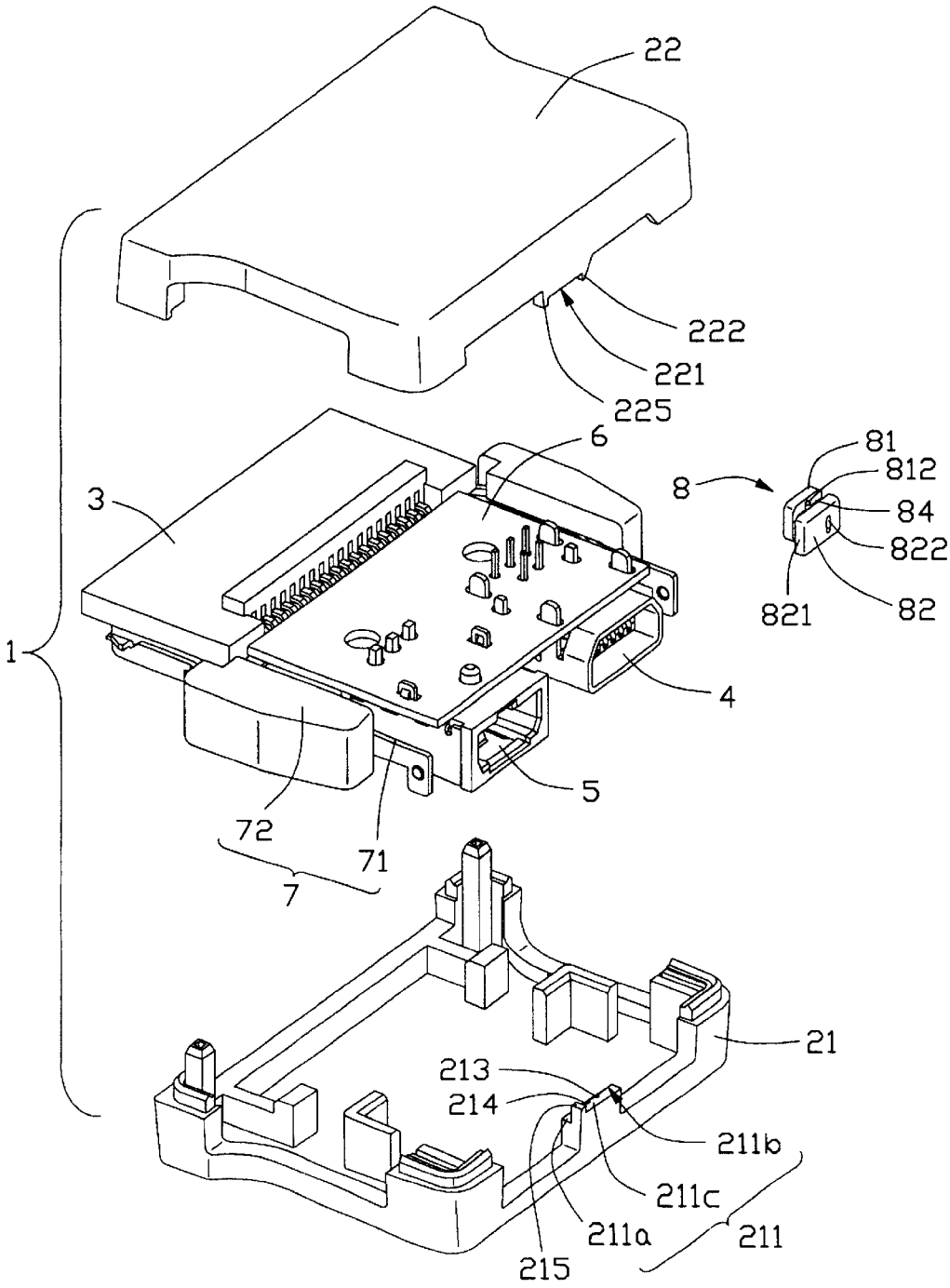
FIG. 2 is an upside-down view of FIG. 1.
Figure 3:
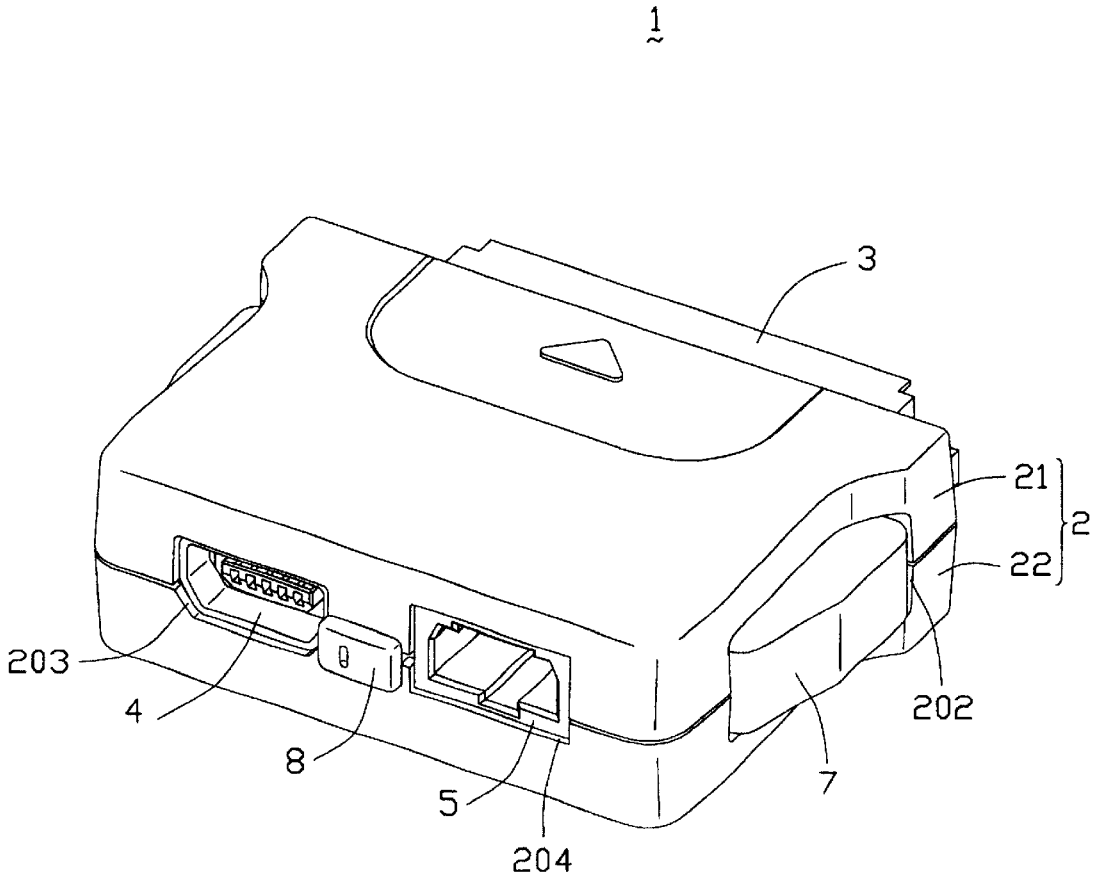
FIG. 3 is an assembled view of FIG. 1, with a theftproof member thereof in an unlocked position.

As shown in FIGS. 1–3, an electrical connector according to a preferred embodiment of the present invention is an adaptor 1. The adaptor 1 comprises an insulative casing 2, an input/output (I/O) plug 3, a Universal Serial Bus (USB) receptacle 4, a power jack 5 for mating with a power plug 9 (shown in FIG. 4), a circuit board 6, a latch mechanism 7 and a theftproof member 8.

The casing 2 includes an upper case 21 and a lower case 22 which mount together to define an interior space (not labeled) for receiving the circuit board 6. The casing 2 defines a front opening (not shown) in a front surface thereof, through which the I/O plug 3 mates with a mating connector (not shown). The casing 2 defines a pair of receiving holes 202 in opposite sides for receiving the latch mechanism 7. A pair of rear openings 203, 204 is defined in a rear wall (not labeled) of the casing 2 for facilitating engagements between the USB receptacle 4 and a USB plug (not shown), and between the power jack 5 and the power plug 9.

The lower case 22 forms a lower step guide portion 221 in an upper surface of the rear wall thereof and between the rear openings 203, 204. The lower step guide portion 221 comprises a top surface 221*a*, a side wall 221*b* and a bottom surface 221*c*. The side wall 221*b* defines a lower standby groove 223 and a lower locking groove 224 in a vertical direction and parallel to each other. A lower protrusion 225 and a substantially triangular block 222 upwardly project beyond the top surface 221*a* from opposite ends of the lower step guide portion 221. Correspondingly, the upper case 21 forms an upper step guide portion 211 having a top surface 211*a*, a side wall 211*b* and a bottom surface 211*c*. The side wall 211*b* also defines an upper standby groove 213 and an upper locking groove 214 therein. The upper step guide portion 211 downwardly forms an upper protrusion 215 corresponding to the lower protrusion 225. When the upper and lower cases 21, 22 are assembled together, the upper step guide portion 211 and the lower step guide portion 221 define a space 20 (shown in FIG. 5) therebetween for relatively movably accommodating the theftproof member 8 therein.

The I/O plug 3, the USB receptacle 4 and the power jack 5 are mounted in predetermined positions of the circuit board 6 and are electrically connected with corresponding circuit traces (not shown) of the circuit board 6.

The latch mechanism 7 is retained in the receiving holes 202 and comprises a pair of latch arms 71 and a pair of push buttons 72 corresponding to the latch arms 71. When the I/O plug 3 mates with the mating connector, front portions of the latch arms 71 latch into locking portions of the mating connector. In this latched state, the I/O plug 3 is locked on the mating connector by the latch arms 71 and is secured against disconnecting under application of an unexpected external force. To disengage the I/O plug 3 from the mating connector, the push buttons 72 are squeezed toward each other to inwardly deflect the latch arms 71, thereby releasing the I/O plug 3 from the mating connector.

The theftproof member 8 comprises a base portion 80, a front portion 81 and a rear portion 82 longer than the front portion 81. The front and rear portions 81, 82 are parallel to each other and sandwich the base portion 80 therebetween.

A U-shaped channel (not labeled) is defined around the base portion 80 and between the front portion 81 and the rear portion 82. The U-shaped channel comprises an upper guide channel 83, a side engaging channel 85 and a lower guide channel 84. The upper guide channel 83 and the lower guide channel 84 are parallel to each other and are defined symmetrically and horizontally in upper and lower portions of the theftproof member 8 for slideably mating with corresponding step guide portions 211, 221. The side engaging channel 85 communicates with the upper and the lower guide channels 83, 84 and is defined in a right side of the theftproof member 8 in a vertical direction for detachably mating with the protrusions 215, 225. An upper engaging rib 811 projects from the front portion 81 into the upper guide channel 83. Symmetrically, a lower engaging rib 812 projects from the front portion 81 into the lower guide channel 84. The engaging ribs 811, 812 are adapted to slideably engage with corresponding standby grooves 213, 223 or corresponding locking grooves 214, 224 as the theftproof member 8 moves along the step guide portions 211, 221. The rear portion 82 has a latch portion 821 extending rightwards therefrom near the side engaging channel 85. The rear portion 82 defines a recess 822 in an outer surface thereof.

Figure 4:
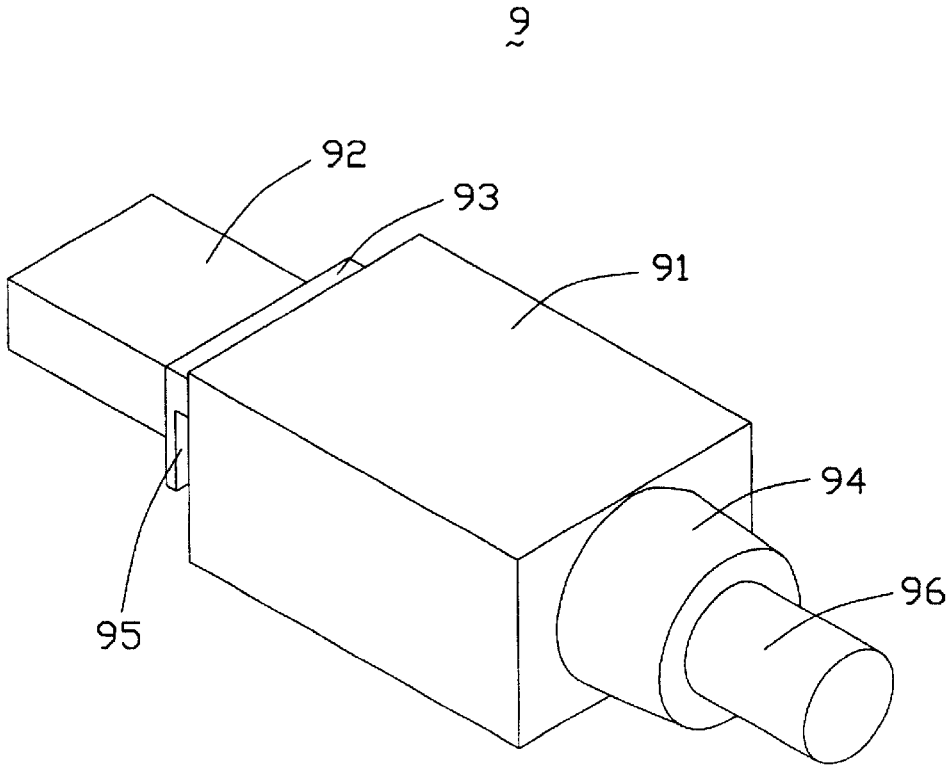
FIG. 4 is a perspective view of a power plug for mating with the electrical connector of FIG. 3.

Referring to FIG. 4, the power plug 9 is provided for electrically connecting the power jack 5 with a power supply (not shown) via a cable 96. The power plug 9 comprises a base portion 91, a mating portion 92, a retaining portion 93 forwardly extending from the base portion 91 for retaining the mating portion 92, and a strain relief 94 for retaining the cable 96. A receiving recess 95 is defined in a left side of the retaining portion 93.

In assembly, the theftproof member 8 is movably accommodated by the space 20 defined between the step guide portions 211, 221, with the upper and the lower guide channels 83, 84 movably engaging with the corresponding step guide portions 211, 221.

Figure 5:
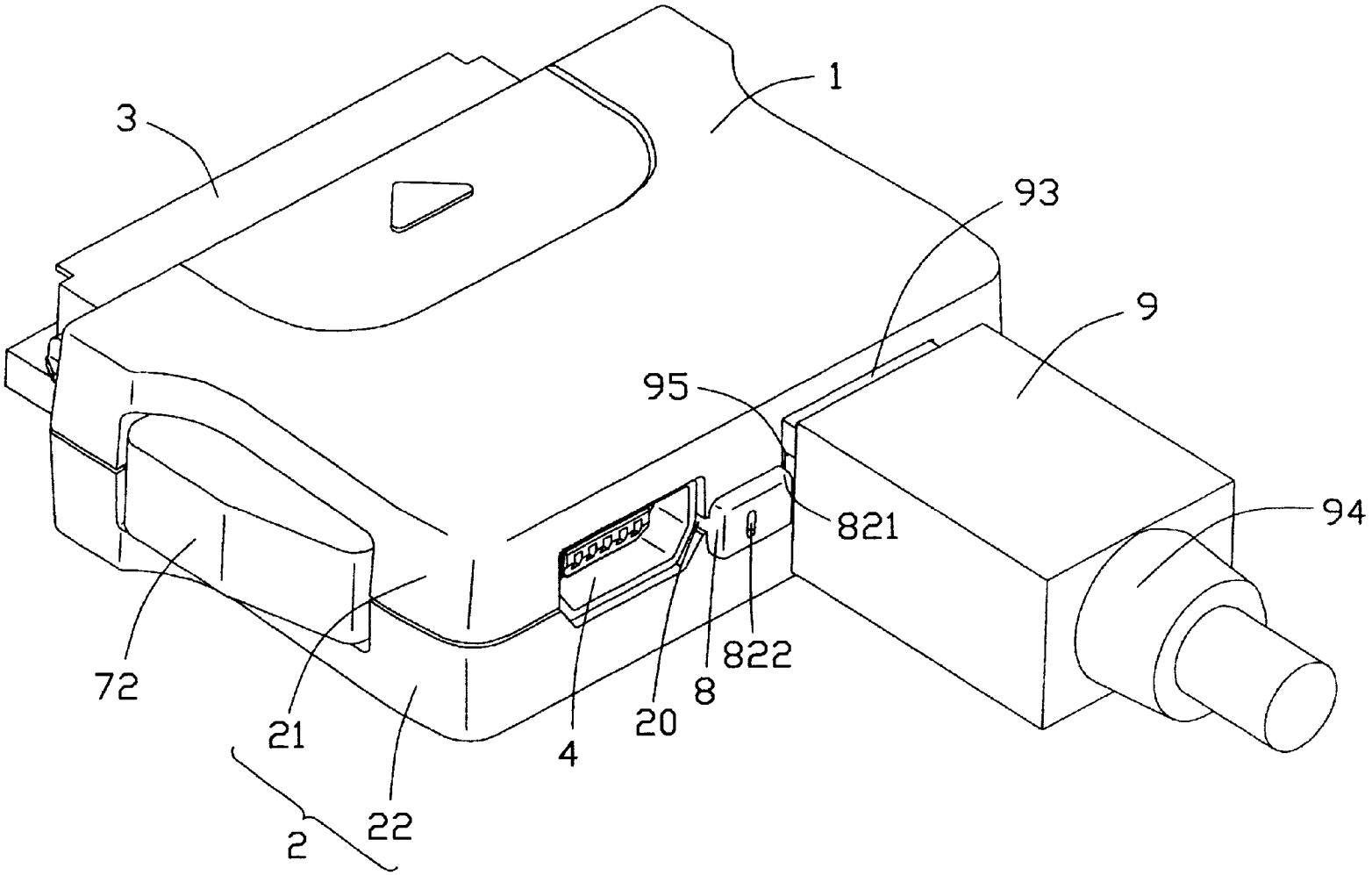
FIG. 5 is an assembled view of FIGS. 3 and 4, with the theftproof member disengaged from the power plug in the unlocked position.
Figure 6:
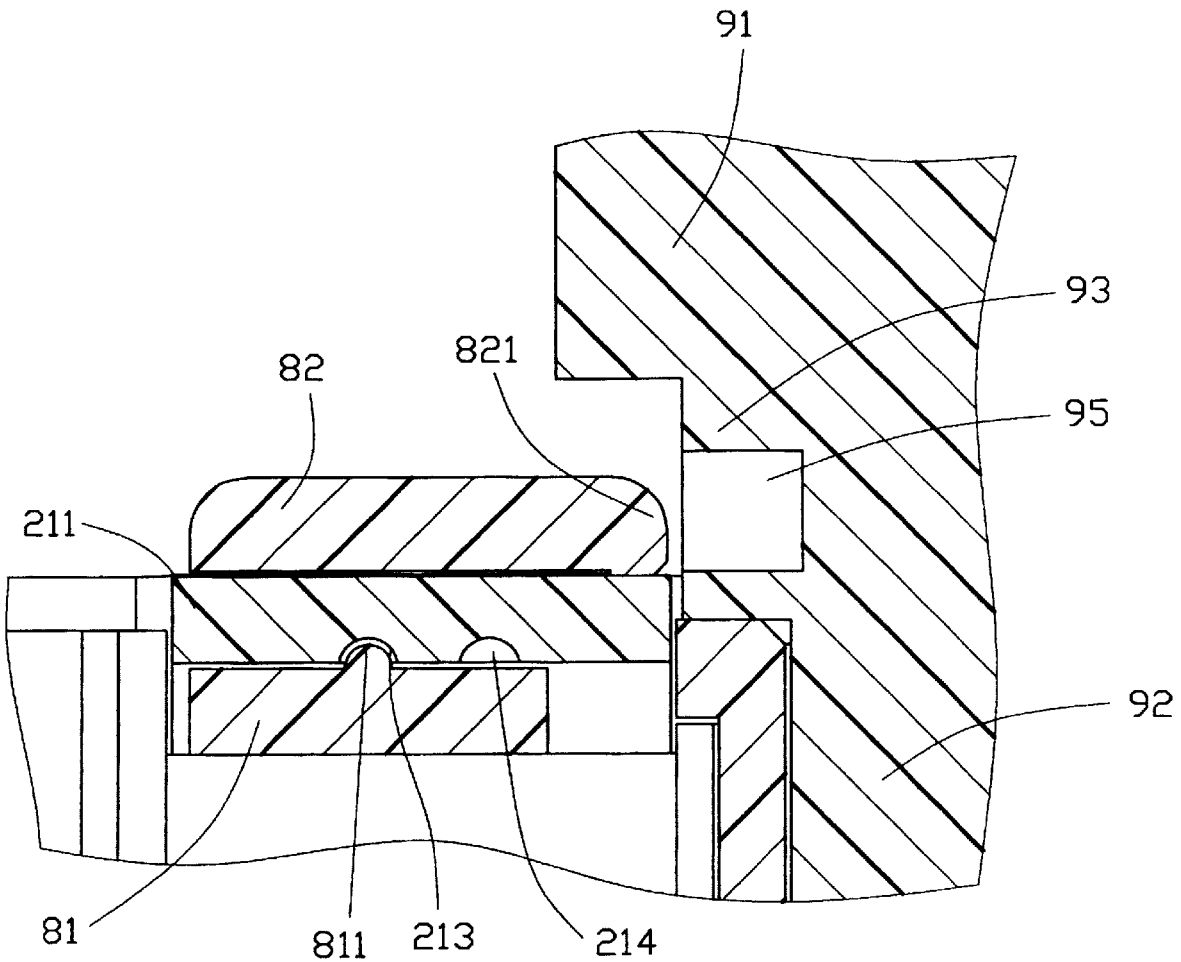
FIG. 6 is a partial, cross-sectional view of FIG. 5, with the theftproof member in the unlocked position.

Referring to FIG. 3, the engaging ribs 811, 812 of the theftproof member 8 engage with corresponding standby grooves 213, 223 in an unlocked position of the theftproof member 8. Referring to FIGS. 5 and 6, in practical use, when the power plug 9 mates with the power jack 5, the theftproof member 8 is first in an unlocked position thereof.

Figure 7:
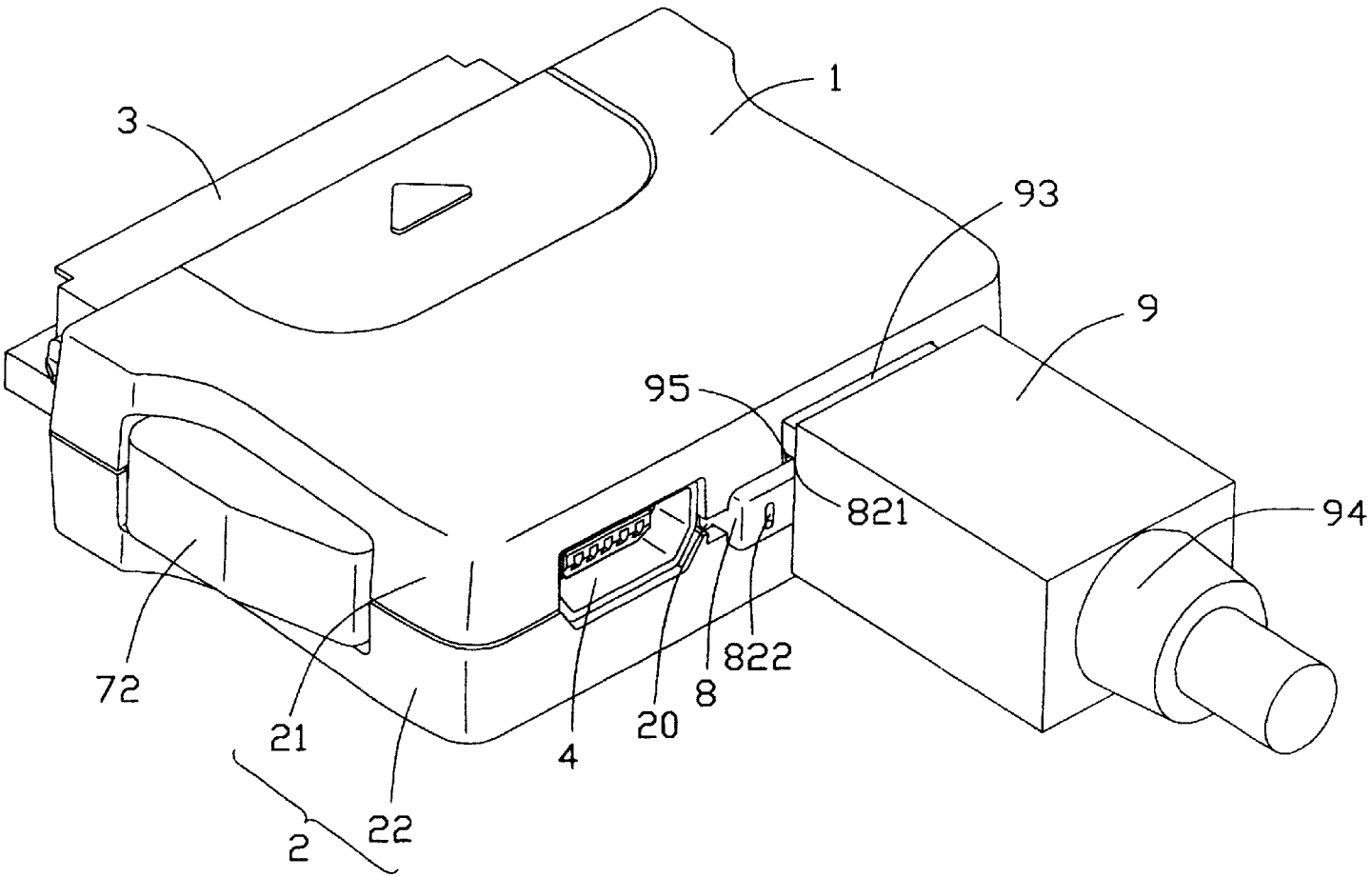
FIG. 7 is a view similar to FIG. 5, but with the theftproof member engaging with the power plug in a locked position.
Figure 8:
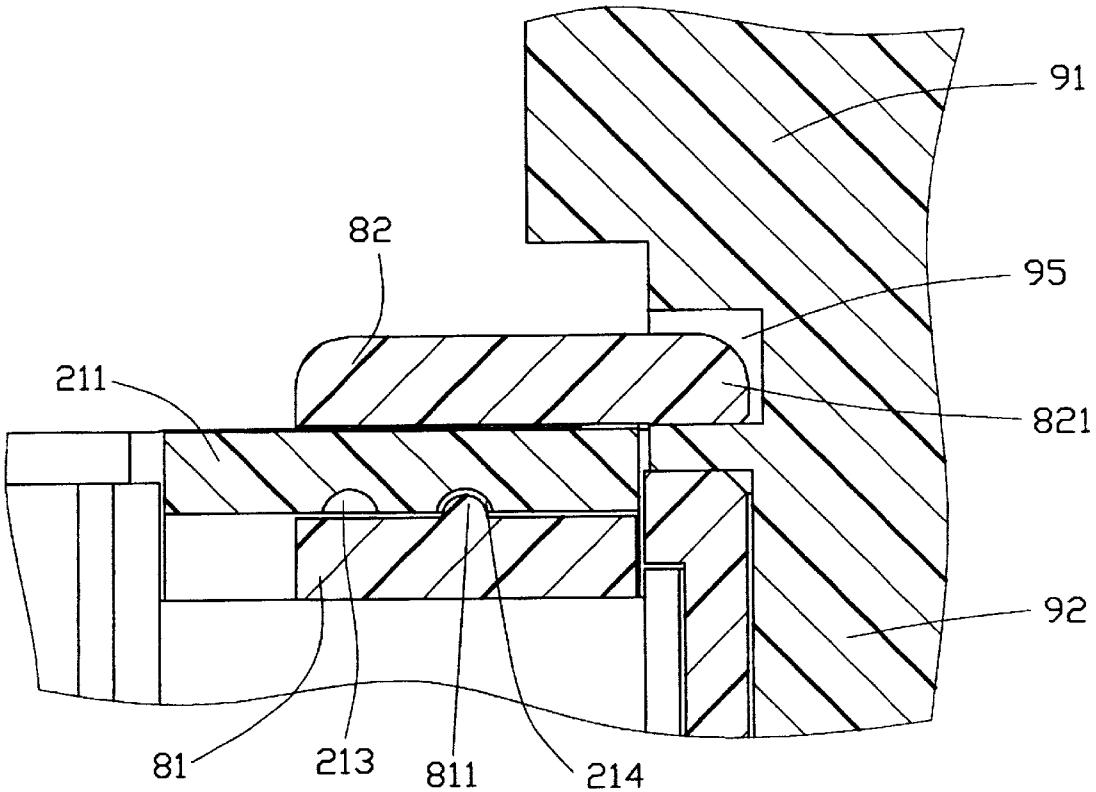
FIG. 8 is a partial, cross-sectional view of FIG. 7, with the theftproof member in the locked position.

By inwardly and rightward pushing the rear portion 82 of the theftproof member 8, the engaging ribs 811, 812 disengage from the corresponding standby grooves 213, 223 and the theftproof member 8 thus moves rightward along the guide portions 211, 221. Referring to FIGS. 7 and 8, the theftproof member 8 is then biased into a locked position thereof with the engaging ribs 811, 812 engaging with corresponding upper and lower locking grooves 214, 224, and with the side engaging channel 85 engaging with the protrusions 215, 225. As a result, the latch portion 821 latches into the receiving recess 95 of the power plug 9 to lock the adaptor 1 on the power plug 9. The block 222 and the protrusions 215, 225 prevent the theftproof member 8 from excessively moving along the step guide portions 211, 221. Note that the theftproof member 8 can be manually moved without use of a special tool from the unlocked to the locked position.

In the locked position as shown in FIGS. 7 and 8, the engaging ribs 811, 812 of the theftproof member 8 engage with the corresponding locking grooves 214, 224, and the latch portion 821 of the rear portion 82 of the theftproof member 8 is received in the receiving recess 95 of the power plug 9. Only after the engaging ribs 811, 812 of the theftproof member 8 are biased from the upper and lower locking grooves 214, 224 into the corresponding upper and lower standby grooves 213, 223 to the unlocked position of the theftproof member 8, can the adaptor 1 be removed from the power plug 9. However, without a removal tool (not shown), the locked adaptor 1 cannot be removed from the plug 9 because the theftproof member 8 is too small to be manually biased from the locked position to the unlocked position. The removal tool has a flat end configured according to the recess 822. To remove the adaptor 1 from the power plug 9, the flat end of the removal tool is first inserted into the recess 822 of the theftproof member 8, and an inward and leftward removing force is then exerted on the theftproof member 8 to bias the theftproof member 8 into the unlocked position thereof.

Therefore, the theftproof member 8 functions as a security lock and can prevent unauthorized removal of the adaptor 1 from the power plug 9 in public locations, such as market places and the like. From another viewpoint, the theftproof member 8 may also function as a anti-mismating device which may block the mis-insertion of the unwanted plug when no plug is mated therewith.

Alternatively, the engaging ribs 811, 812 can be respectively formed on the upper and the lower cases 21, 22, and the standby grooves 213, 223 and the locking grooves 214, 224 can be defined in the front portion 81 in communication with corresponding guide channels 83, 84. As the theftproof member 8 moves, the standby grooves 213, 223 or the locking grooves 214, 224 move to engage with the engaging ribs 811, 812. In this alternative embodiment, other elements of the adaptor have constructions similar to those of the first embodiment; thus, a detailed description thereof is omitted herefrom.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first connector having a casing;

a second connector for mating with the first connector, defining a receiving recess therein; and a theftproof member movably disposed on the casing of the first connector and having a latch portion, the theftproof member being movable between an unlocked position where the latch portion is disengaged from the receiving recess of the second connector and a locked position where the latch portion is latched into the receiving recess of the second connector; wherein the casing of the first connector comprises a first case and a second case mounted on the first case; wherein the casing of the first connector is formed with a guide portion for engaging with the theftproof member, the guide portion having a stepped configuration and comprising a locking section; wherein the locking section of the guide portion of the casing of the first connector is in the form of a locking groove, and wherein the theftproof member forms an engaging rib for mating with the locking section of the guide portion of the casing when the theftproof member is biased into the locked position; wherein the guide portion of the casing of the first connector defines a standby groove mating with the engaging rib of the theftproof member when the theftproof member is biased into the unlocked position; wherein the theftproof member comprises a base portion, and a front portion and a rear portion sandwiching the base portion, the base portion defining a guide channel for movably engaging with the guide portion of the casing of the first connector; wherein the latch portion of the theftproof member extends from the rear portion.

2. The electrical connector assembly according to claim 1, wherein the rear portion of the theftproof member defines a recess therein for facilitating biasing of the theftproof member from the locked position to the unlocked position.

3. The electrical connector assembly according to claim 1, wherein the theftproof member defines an engaging channel substantially perpendicular to the guide channel, and wherein the guide portion of the casing of the first connector forms a protrusion at an end thereof for engaging with the engaging channel when the theftproof member is in the locked position.

4. An electrical connector assembly comprising:

a first connector formed with a guide portion, the guide portion comprising a locking section;

a second connector for mating with the first connector, defining a receiving recess therein; and a theftproof member movably engaging with the guide portion of the first connector and comprising a latch section for engaging with the receiving recess of the second connector and an engaging section for engaging with the locking section of the first connector;

wherein the theftproof member is movable between an unlocked position where the latch section is disengaged from the receiving recess of the second connector and the engaging section thereof is disengaged from the locking section of the first connector, and a locked position where the engaging section thereof engages with the locking section of the first connector and where the latch section latches into the receiving recess of the second connector; wherein the casing comprises a first case and a second case mounted on the first case; wherein the guide portion of the first connector has a stepped configuration, and wherein the locking section is in the form of a groove; wherein the theftproof member comprises a base portion, and a front portion and a rear portion sandwiching the base portion, the base portion defining a guide channel movably engaging with the guide portion of the first connector; wherein the engaging section is in the form of a rib and projects from the front portion into the guide channel, and wherein the guide portion further defines a standby groove for mating with the engaging section when the theftproof member is biased into the unlocked position; wherein the latch portion of the theftproof member extends from the rear portion.

5. The electrical connector according to claim 4, wherein the theftproof member defines an engaging channel substantially perpendicular to the guide channel, and wherein the guide portion of the first connector forms a protrusion at an end thereof for engaging with the engaging channel when the theftproof member is in the locked position.

* * * * *